US010806223B2

(12) United States Patent
Coraci et al.

(10) Patent No.: US 10,806,223 B2
(45) Date of Patent: Oct. 20, 2020

(54) BRACELET CUP

(71) Applicants: Dawn Ellen Coraci, Lathrup Village, MI (US); Jason Michael Keenan, Dearborn, MI (US); Kristen Grace Keenan, Dearborn, MI (US)

(72) Inventors: Dawn Ellen Coraci, Lathrup Village, MI (US); Jason Michael Keenan, Dearborn, MI (US); Kristen Grace Keenan, Dearborn, MI (US)

( * ) Notice: Subject to any disclaimer, the term of this patent is extended or adjusted under 35 U.S.C. 154(b) by 117 days.

(21) Appl. No.: 16/168,338

(22) Filed: Oct. 23, 2018

(65) Prior Publication Data

US 2019/0116943 A1 Apr. 25, 2019

Related U.S. Application Data

(60) Provisional application No. 62/577,131, filed on Oct. 25, 2017.

(51) Int. Cl.
*A44C 5/00* (2006.01)
*A47G 19/22* (2006.01)
(Continued)

(52) U.S. Cl.
CPC ..... *A44C 5/0007* (2013.01); *A44C 5/0053* (2013.01); *A47G 19/00* (2013.01); *A47G 19/2205* (2013.01); *A47G 19/2227* (2013.01); *A44C 15/00* (2013.01); *A47G 2019/2277* (2013.01); *B65D 5/36* (2013.01)

(58) Field of Classification Search
CPC ..... A44C 5/0007; A44C 5/0053; A44C 9/00; A44C 5/00; A44C 15/001; A44C 25/00; A47G 19/00; A47G 19/2205; A47G 19/2227; A47G 2019/227; A45F 2005/008; A45F 5/00; A45F 3/20; A45F 2003/205;
(Continued)

(56) References Cited

U.S. PATENT DOCUMENTS 1,690,586 A 11/1928 Main
3,373,917 A * 3/1968 Cox ..... B65D 5/603 229/117.27

(Continued)

OTHER PUBLICATIONS

How to Make A Cup From Paper at School, obtained from https://www.artistshelpingchildren.org/images-08/making-paper-cups-at-school.png on Oct. 3, 2018, 1 page.

*Primary Examiner* — Christopher R Demeree
(74) *Attorney, Agent, or Firm* — Wayne State Patent Clinic

(57) ABSTRACT

A foldable cup bracelet is provided. The foldable cup bracelet includes a sheet of resilient material, a first pair of fasteners, and a second pair of fasteners. The sheet of resilient material is foldable between a bracelet configuration and a cup configuration. The bracelet configuration includes a continuous band having an inner surface and an outer surface. The cup configuration includes a first side wall and a second side, and defines an interior for receiving a liquid or other substance between the first and second side walls. The cup configuration may form a drinking cup. The first pair of fasteners is configured to retain the sheet of resilient material in the bracelet configuration, and the second pair of fasteners is configured to cooperate with the first pair of fasteners to retain the sheet of resilient material in the cup configuration.

20 Claims, 10 Drawing Sheets

(51) Int. Cl.
*A47G 19/00* (2006.01)
*A44C 15/00* (2006.01)
*B65D 5/36* (2006.01)

(58) Field of Classification Search
CPC .. A45F 5/102; B65D 3/06; B65D 5/36; B65D 5/4279; B65D 5/3678
USPC ..... 229/400, 402, 405, 4.5; 220/738, 666, 7; 224/222, 267; D7/512; 211/132.1, 211/126.6, 130.1, 85
See application file for complete search history.

(56) References Cited

U.S. PATENT DOCUMENTS

| | | | | |
|---|---|---|---|---|
| 4,284,205 | A | 8/1981 | Hirata | |
| 4,736,876 | A | 4/1988 | Kriss | |
| 5,842,634 | A | 12/1998 | Kieler | |
| 6,029,938 | A * | 2/2000 | Fava | A45F 5/00 108/43 |
| 7,637,417 | B2 | 12/2009 | Fite, IV et al. | |
| 10,617,247 | B1 * | 4/2020 | Galdun | F16M 13/04 |
| 2005/0103834 | A1 | 5/2005 | Cousins | |
| 2014/0217256 | A1 * | 8/2014 | Young | F16M 13/04 248/311.2 |
| 2015/0069096 | A1 * | 3/2015 | Kampas | A45F 5/00 224/148.6 |
| 2016/0159518 | A1 * | 6/2016 | Hollis | A45F 3/20 220/7 |

* cited by examiner

BRACELET CUP

CROSS-REFERENCE TO RELATED APPLICATIONS

This application claims priority to and all of advantages of U.S. Prov. Appl. No. 62/577,131, filed on 25 Oct. 2017, the content of which is herein incorporated by reference.

FIELD OF THE INVENTION

The present disclosure generally relates to portable vessels and, more specifically, to articles interconvertible between independent jewelry and container forms.

BACKGROUND

Cups, such as drinking cups, are ubiquitous among a wide range of cultures and societies, and have been used throughout human history for transporting liquids and carrying beverages. Cups may be utilitarian, or adorned and/or decorated with artistic accoutrements.

Recently, public use of cups outside of homes and food-service establishments has waned. Despite their widespread historic use, cups have been relegated to home cupboards and restaurants in favor of disposable or reusable containers, such as water bottles. Disposable plastic water bottles have become increasingly popular, and are used extensively during outdoor events such as concerts and festivals. Unfortunately, manufacturing and transportation and such water bottles requires large amounts of energy and non-renewable resources such as petroleum. Additionally, single-use and disposable water bottles contribute significantly to waste streams, especially during well-attended events like concerts and festivals.

SUMMARY OF THE INVENTION

An improved cup is provided. More specifically, the present disclosure provides a wearable, foldable cup bracelet (the "bracelet cup"), and methods of making and using the same. The foldable cup bracelet includes a sheet of resilient material, a first pair of fasteners, and a second pair of fasteners. The sheet of resilient material is foldable between a bracelet configuration and a cup configuration.

In the bracelet configuration, the bracelet cup is configured for use as a bracelet, which may be worn by a user for ease of transportation, aesthetic use (e.g. as jewelry), and the like. In the bracelet configuration, the bracelet cup includes a continuous band having an inner surface and an outer surface. The first pair of fasteners are disposed on the continuous band and configured to retain the sheet of resilient material in the bracelet configuration, e.g. about a wrist of the user. Optionally, the first pair of fasteners are selected from a plurality of fasteners, such that a circumference (e.g. a size) of the continuous band is adjustable.

In the cup configuration, the bracelet cup is configured for use as a vessel, e.g. for holding and transporting a substance. In the cup configuration, the bracelet cup includes a first side wall and a second side, and defines an interior between the first and second side walls for receiving the substance. The second pair of fasteners is configured to cooperate with the first pair of fasteners to retain the sheet of resilient material in the cup configuration.

These and other features and advantages of the present disclosure will become apparent from the following description of particular embodiments, when viewed in accordance with the accompanying drawings and appended claims.

DETAILED DESCRIPTION OF THE INVENTION

Referring to FIGS. 1-6, wherein like numerals indicate corresponding parts throughout the several views, a foldable cup bracelet is illustrated and generally designated 10. The foldable cup bracelet 10 is also referred to herein as the "bracelet cup 10". Certain features of the bracelet cup 10 are functional, but can be implemented in different aesthetic configurations.

Figure 1A:
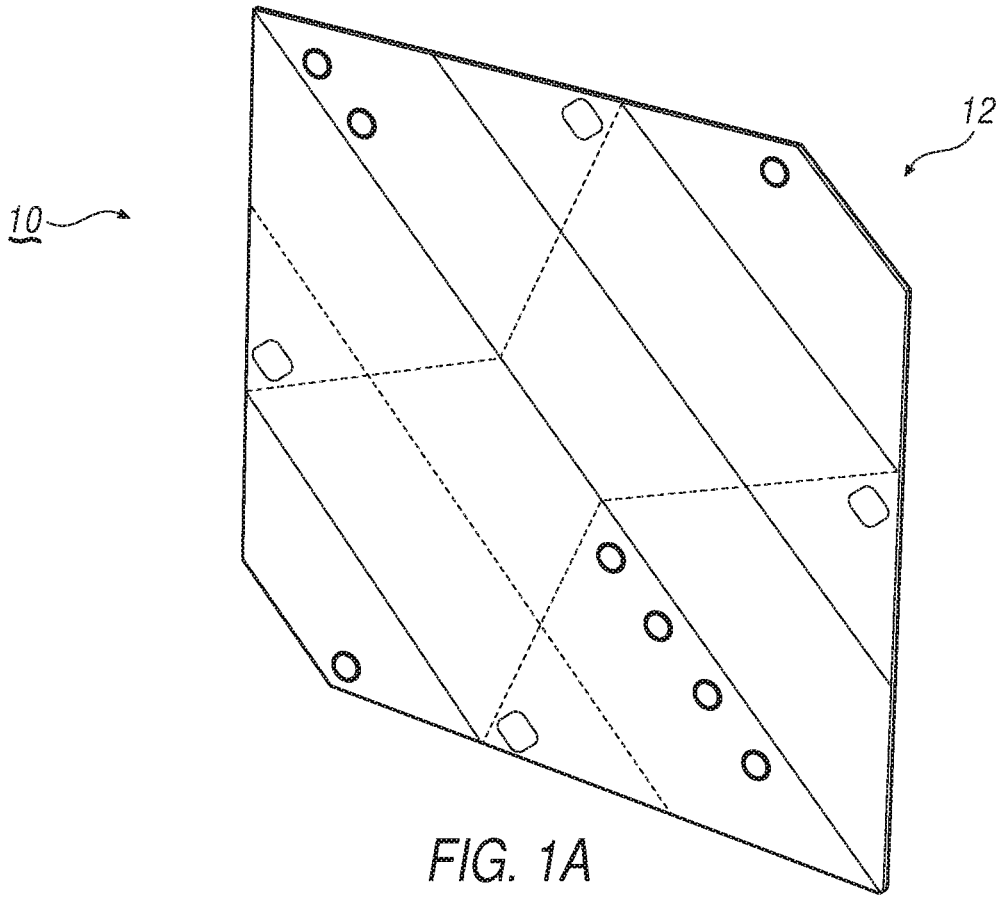
FIG. 1A is a perspective view of a bracelet cup in accordance with one embodiment.
Figure 1B:
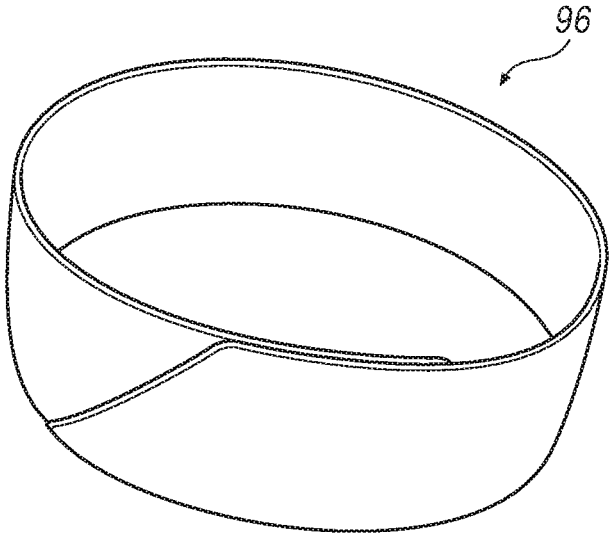
FIG. 1B is a perspective view of the bracelet cup of FIG. 1A in a bracelet configuration in accordance with one embodiment.
Figure 1C:
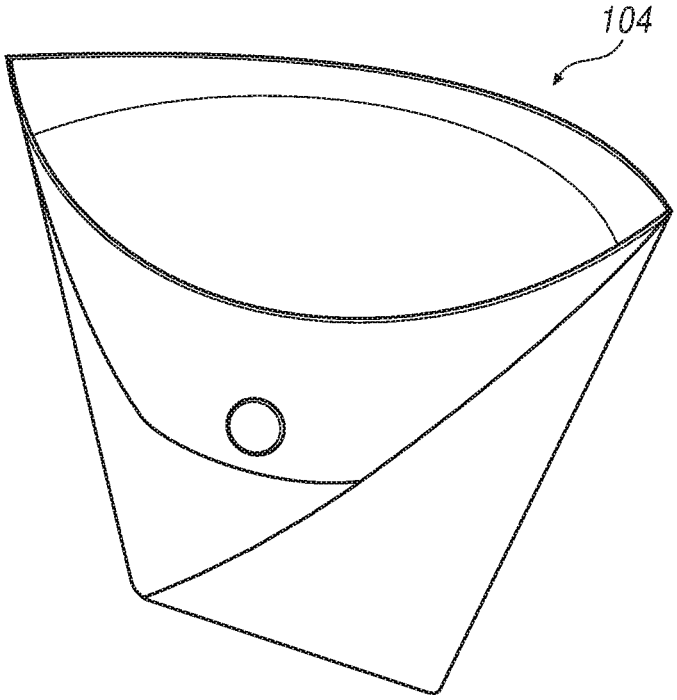
FIG. 1C is a perspective view of the bracelet cup of FIG. 1A in a cup configuration in accordance with one embodiment.

As shown in FIG. 1A, the bracelet cup 10 comprises a sheet 12. The sheet 12 is foldable between a bracelet configuration 96 and a cup configuration 104, as shown generally in FIGS. 1B and 1C, respectively. Typically, the sheet 12 is composed of a resilient material, as described in further detail below. Accordingly, the sheet 12 may also be referred to herein as "the sheet of resilient material 12". The sheet 12 may be of any size, shape, and/or dimension (e.g. thickness, density, etc.), which are typically independently selected, e.g. based on the materials utilized, a desired size of the bracelet and/or cup to be formed, etc. In some embodiments, the sheet 12 may comprise a polygonal perimeter shape having a generally square, rectangular, or rhomboidal shape. In certain embodiments, the sheet 12 comprises a substantially square, rectangular, or rhomboidal shape modified at one or more corners (e.g. via rounding, trimming, cutting, etc.) to form additional sides. In some embodiments, as exemplified in FIG. 2, the sheet 12 has a symmetrical irregular-hexagonal perimeter shape. More specifically, the irregular hexagonal perimeter shape of sheet 12 includes two opposing vertices (e.g. right vertices) that are bisected by a reference line 14. The reference line 14 separates two congruent portions 26, 26', which may be reflected about the reference line 14. For clarity, the congruent portions 26, 26' are subsequently referred to herein as "the first portion 26" and "the second portion 26'," respectively, with similar elements designated with like numerals, and elements of the second portion 26' given a prime designation (i.e., "'"). However, as the first and second portions 26, 26' are congruent, certain features are described herein with reference to both of the first and second portions 26, 26'. Individual characteristics of either of the first and/or second portions 26, 26' will be designated accordingly.

In particular embodiments, each of the first and second portions 26, 26' has an isosceles-trapezoidal perimeter shape defined by a long base side 28, 28' and a short base side 30, 30' that is parallel to the long base side 28, 28'. In the embodiments exemplified in FIG. 2, the long base sides 28, 28' overlap with one another at the reference line 14. Each of the first and second portions 26, 26' also has opposing first and second diagonal sides 36, 36', 37, 37', respectively, which are acutely joined at first and second ends 29, 29' of the long base side 28, 28' and obtusely joined at a first end 32, 32' and a second end 34, 34' of the short base side 28, 28', respectively.

Typically, each of the first and second portions 26, 26' comprises a base region 38, 38' proximal to the long base side 28, 28', a top region 44, 44' proximal the short base side 30, 30', and a body region 40, 40' between the base region 38, 38' and the top region 44, 44'. As described in further detail below, these various regions of the first and second portions 26, 26' are independently shaped and sized to affect a portion of the cup and bracelet formed with the sheet 12. In certain embodiments, each of the base region 38, 38', body region 40, 40', and top region 44, 44' has an isosceles-trapezoidal perimeter shape. In these or other embodiments, each of the base region 38, 38', body region 40, 40', and top region 44, 44' has a height equal to about a third of the first or second portion 26, 26', respectively.

Typically, the sheet 12 comprises various living hinges in order to promote folding thereof, e.g. into the bracelet configuration 96 and/or the cup configuration 104. These various living hinges, which may also be referred to as flexure bearings, are described below.

Figures 2A, 2B:
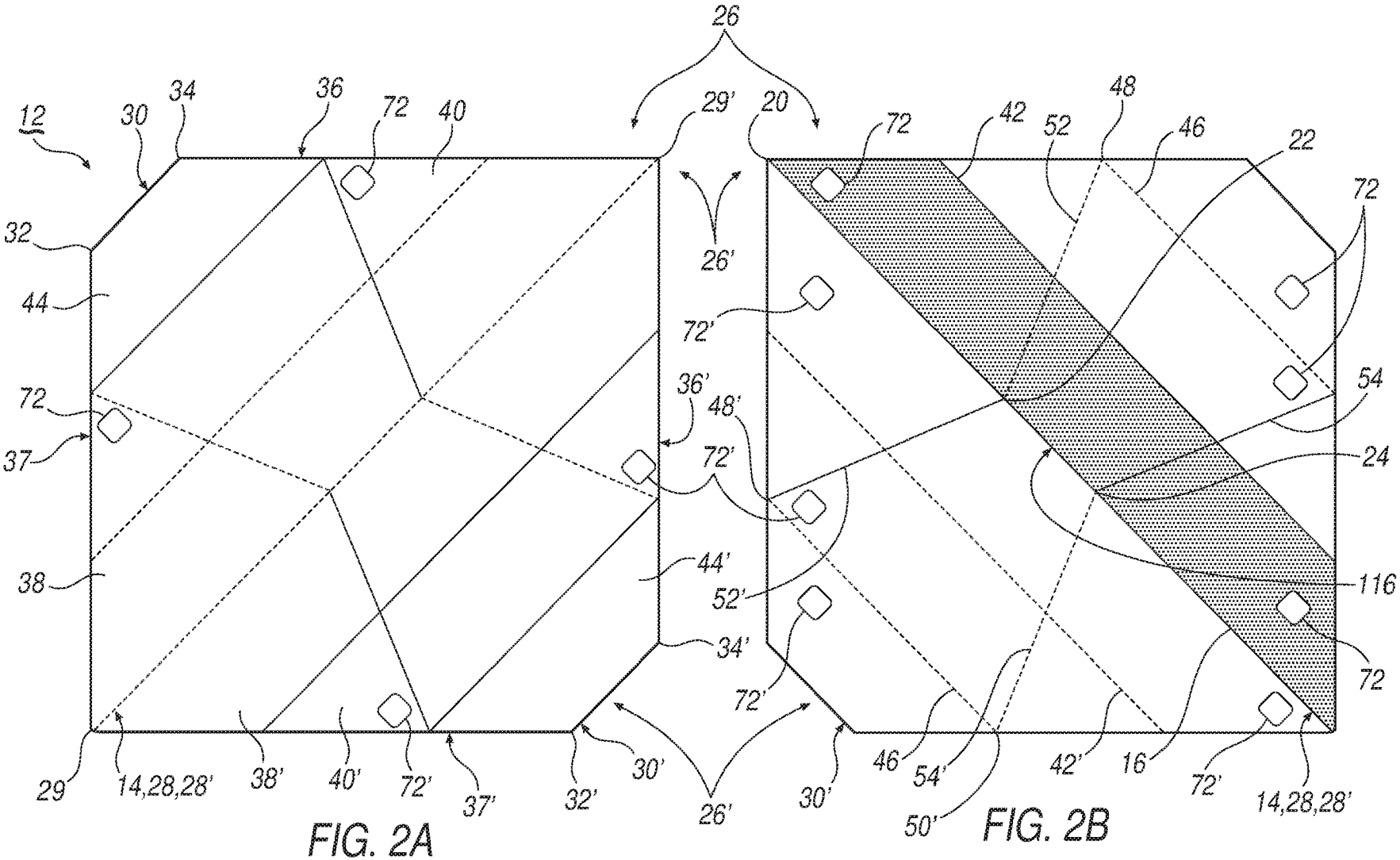
FIG. 2A is a top view of a resilient sheet in accordance with one embodiment the bracelet cup.
FIG. 2B is a bottom view of the resilient sheet of FIG. 1A.

In particular embodiments, as shown in FIG. 2, the sheet 12 comprises a central living hinge 16 between and operatively connected to the first and second portions 26, 26'. The central living hinge 16 extends parallel to the short base sides 28, 28' from a first end 18 to a second end 20 along the reference line 14, and is connected to the base regions 38, 38' of the first and second portions 26, 26'. As such, the sheet 12 is configured to be reflectively folded in half via the central living hinge 16 to align together the first and second portions 26, 26', as described in further detail below.

In some embodiments, each of the first and second portions 26, 26' further comprises a medial living hinge 42, 42' between and operatively connected to the base region 38, 38' and the body region 40, 40'. The medial living hinge 42, 42' is typically parallel to the central living hinge 16. Accordingly, in such embodiments, each of the first and second portions 26, 26' is configured to be folded via the medial living hinge 42, 42' to bring together the base region 38, 38' and the body region 40, 40'. In these or other embodiments, each of the first and second portions 26, 26' may also comprise a distal living hinge 46, 46' between and operatively connected to the body region 40, 40' and the top region 44, 44'. The distal living hinge 46, 46' typically extends between a first end 48, 48' and a second end 50, 50' parallel to both of the central living hinge 16 and the medial living hinge 42, 42'. In such embodiments, each of the first and second portions 26, 26' is configured to be folded via the distal living hinge to bring together the body region 40, 40' and the top region 44, 44'.

Figure 2C:
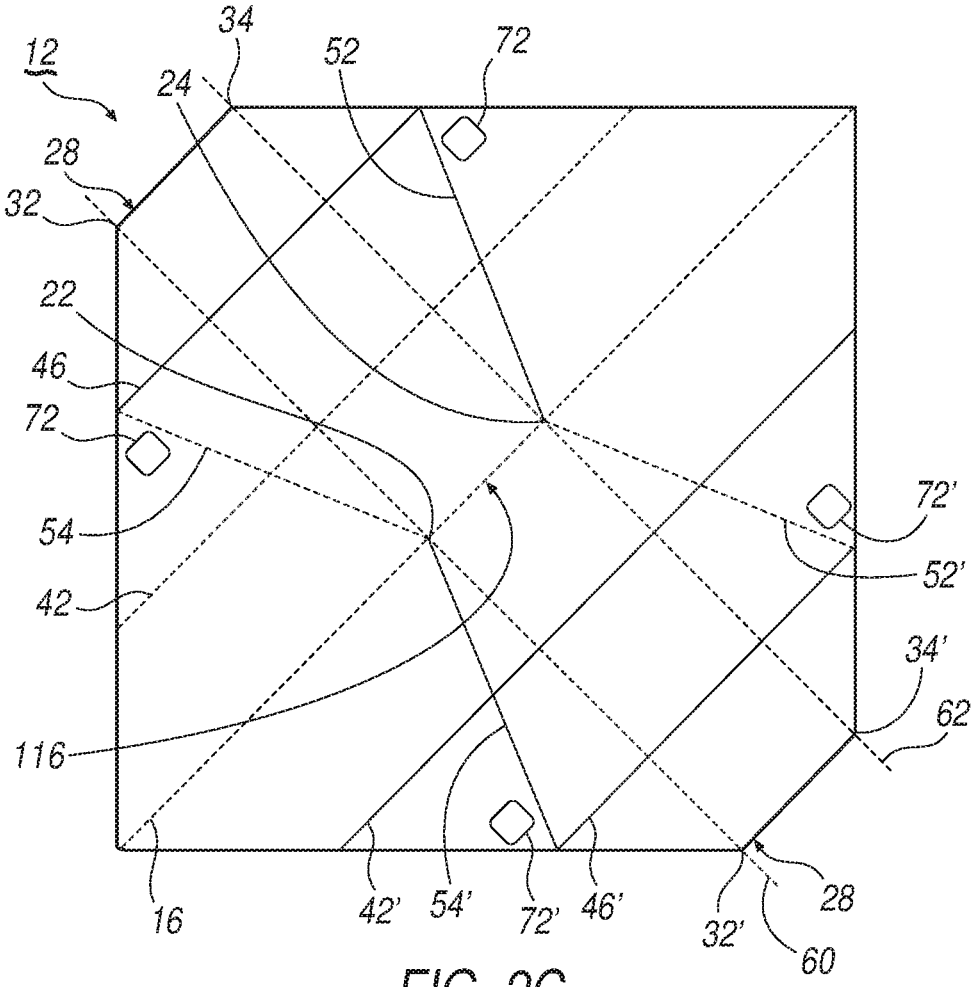
FIG. 2C is a top view of a resilient sheet in accordance with another embodiment the bracelet cup bracelet cup of FIG. 1A.

In certain embodiments, each of the first and second portions 26, 26' comprises a first lateral living hinge 52, 52' that extends inwardly from the first end 48, 48' of the distal living hinge 46, 46' to a first location 22 of the central living hinge 16, and a second lateral living hinge 54, 54' that extends inwardly from the second end 50, 50' of the distal living hinge 54, 54' to a second location 24 of the central living hinge 16. As described below, the portion of the base regions 38, 38' between the first and second locations 22, 24 of the central living hinge 16 later define a bottom portion 116 of the cup configuration 104. As such, the first and second locations 22, 24 of the central living hinge 16 are typically spaced apart for a distance along the reference line 14. For example, in some embodiments, as best shown in FIG. 2C, the first location 22 is located at an intersection of a reference line 60 extending perpendicularly to the central living hinge 16 between the first ends 32, 32' of the short base sides when the sheet 12 is in the flat (i.e., unfolded) state. Likewise, the second location 24 is located at an intersection of a reference line 62 extending perpendicularly to the central living hinge 16 between the second ends 34, 34' of the short base sides 28, 28', when the sheet 12 is in the state. In alternative embodiments, the first and second locations 22, 24 are coincident along the central living hinge 16, e.g. at a center point thereof, such that the bottom portion 116 of the cup configuration defines a conical apex (not shown).

The living hinges (e.g. the central living hinge 16, the medial living hinges 42, 42', the distal living hinges 46, 46', and the lateral living hinges 52, 52', 54, 54') are independently selected, and may each be the same as or different from any other of the living hinges, e.g. with respect to a dimension (length, width, depth, etc.). As such, any reference to "the living hinges" may apply to any one or more of the living hinges, such as only one of the living hinges or to all of the living hinges, and is thus not to be considered limiting due to the plural form. In general, the living hinges function to allow various regions and portions of the sheet 12 to be readily folded toward one another. As such, the living hinges of the sheet 12 each comprise an area of decreased resistance to folding, e.g. as compared to other areas of the sheet 12 which comprise a relatively increased resistance to folding. Typically, the living hinges are linear, i.e., allow for a single fold along a length thereof.

Typically, the living hinges are formed in the material of sheet 12, and may be defined as fold lines, score lines, thinned strips of the sheet 12 (i.e., strips having a relatively reduced thickness compared to the rest of the sheet 12), etc. Alternatively, one or more of the living hinges may be formed of a separate material than the sheet 12. The living hinges may each be unidirectional, and thus provide a decreased resistance to folding in only one direction, or bidirectional, and thus provide a decreased resistance to folding in two directions. As such, with reference to the sheet 12 being in a flat (i.e., unfolded) state, as shown in FIG. 2, each of the living hinges may provide for a ridge fold (shown as dashed lines) or a valley fold (shown in solid lines), or may provide for both ridge and valley folds.

As introduced above, the sheet 12 typically comprises a resilient material. The resilient material is not limited, and may comprise various compositions and/or properties, as described herein. Typically, the resilient material is impermeable to water, such that in the cup configuration 104 the bracelet cup 10 is suitable for use as a vessel for storing and/or transporting a liquid (e.g. a drinkable liquid such as water, soft drinks, hard drinks, etc.). However, in certain embodiments, the resilient material is impermeable to liquid water, but allows for the passage of water vapor therethough. In some embodiments, the resilient material is printable, i.e., capable of holding and retaining ink or dye. In these or other embodiments, the resilient material is a safe food contact material. Examples of safe food contact materials include the food additives listed in Title 21 of the Code of Federal Regulations (e.g. 21 CFR 170-170) as revised Apr. 1, 2017, the chemicals and/or substances designated generally recognized as safe (GRAS) by the American Food and Drug Administration (e.g. those exempted from the U.S. Federal Food, Drug, and Cosmetic Act (FFDCA) food additive tolerance requirements, and/or the materials set forth in and/or meeting the general safety requirements as set forth in Regulation (EC) No 1935/2004 of the European Parliament and of the Council of 27 Oct. 2004.

In some embodiments, the sheet 12 comprises a resin. The term "resin" is conventionally used to describe a composition that comprises a polymer (e.g. natural or synthetic) and is capable of being cured and/or hardened (i.e., the resin comprises the composition in an uncured and/or unhardened). However, the term "resin" is also conventionally used to denote a composition comprising a natural or synthetic polymer in a cured and/or hardened state. As such, the term "resin" may be used in a conventional sense to refer to a cured and/or hardened resin, or to an uncured and/or unhardened resin. Accordingly, it is likewise to be understood that, as used herein, the term "resin" may refer to a cured or uncured resin, and the terms "cured resin" and "uncured resin" are used to differentiate between a particular resin in a cured or uncured state.

Suitable resins typically comprise a reaction product of a monomeric unit (e.g. a monomer, oligomer, or polymer) and a curing agent. Curing agents suitable for use in forming the resins typically include at least difunctional molecules that are reactive with functional groups present in the resin-forming monomeric unit. For example, curing agents suitable for use in forming epoxy resins are typically at least difunctional molecules that are reactive with epoxide groups (i.e., comprise two or more epoxide-reactive functional groups). As understood in the art, the terms "curing agent" and "cross-linking agent" can be used interchangeably. Additionally, the curing agent may itself be a monomeric unit, such that resin comprises a reaction product of at least two monomeric unites, which may be the same as or different from one another.

Suitable resins are conventionally named/identified according to a particular functional group present in the reaction product. For example, the term "polyurethane resin" represents a polymeric compound comprising a reaction product of an isocyanate (i.e., a monomeric unit comprising isocyanate functionality) and a polyol (i.e., a chain extender/curing agent comprising alcohol functionalities). The reaction of the isocyanate and the polyol create urethane functional groups, which were not present in either of the unreacted monomer or curing agent. In certain instances, however, resins are named according to a particular functional group present in the monomeric unit (i.e., the functionality at a cure site). For example, the term "epoxy resin" represents a polymeric compound comprising a cross-linked reaction product of a monomeric unit having one or more epoxide groups (i.e., epoxide functionalities) and a curing agent. However, once cured, the epoxy resin is no longer an epoxy, or no longer includes epoxide groups, but for any unreacted or residual epoxide groups (i.e., cure sites), which may remain after curing, as understood in the art. In other instances, however, suitable resins may comprise the reaction product of one or more monomeric units (i.e., where the curing agent itself is also a monomeric unit), each having the same functionality both prior to and after the reaction. In such instances, the resins may be named according to a functional group present in both the monomeric unit and the reaction product (e.g. an unreacted functional group, or a functional group that is modified during reaction but does not change in kind/name). For example, the term "silicone resin" represents a siloxane-functional polymeric compound comprising a reaction product of a monomeric unit comprising a siloxane functional group.

In some embodiments, the resin is selected from thermoset resins and thermoplastic resins. Specific examples of suitable thermoset and/or thermoplastic resins typically include polyamides (PA), such as Nylons; polyesters such as polyethylene terephthalates (PET), polybutylene terephthalates (PET), polytrimethylene terephthalates (PTT), polyethylene naphthalates (PEN), liquid crystalline polyesters, and the like; polyolefins such as polyethylenes (PE), polypropylenes (PP), polybutylenes, and the like; styrenic resins; polyoxymethylenes (POM); polycarbonates (PC); polymethylenemethacrylates (PMMA); polyvinyl chlorides (PVC); polyphenylene sulfides (PPS); polyphenylene ethers (PPE); polyimides (PI); polyamideimides (PAI); polyetherimides (PEI); polysulfones (PSU); polyethersulfones; polyketones (PK); polyetherketones (PEK); polyetheretherketones (PEEK); polyetherketoneketones (PEKK); polyarylates (PAR); polyethernitriles (PEN); resol-type; urea (e.g. melamine-type); phenoxy resins; fluorinated resins, such as polytetrafluoroethylenes; thermoplastic elastomers, such as polystyrene types, polyolefin types, polyurethane types, polyester types, polyamide types, polybutadiene types, polyisoprene types, fluoro types, and the like; and copolymers, modifications, and combinations thereof. Additionally, elastomers and/or rubbers can be added to or compounded with the thermosetting and/or thermoplastic resin to improve certain properties of the sheet 12 such as durability, resiliency, flexibility, printability, and the like.

In particular embodiments, the resin comprises a polyolefin resin, which may be a thermosetting and/or thermoplastic polyolefin resin. Examples of suitable polyolefins include polyethylenes, polypropylenes, polybutylenes, and the like. In some embodiments, the polyolefin resin is a high-density polyolefin resin, such as a high-density polyethylene resin (HDPE) or a high-density polypropylene resin (HDPP), or a high-density blend of various polyolefin resins. Particular examples of suitable high-density polyethylene resins include those market under the trade name Tyvek® (R) and provided by DowDuMont of Midland, Mich., U.S.A.

In certain embodiments, the resin comprises a polyurethane resin, which may be a thermosetting and/or thermoplastic polyurethane resin. Examples of suitable polyurethanes include condensation products of a polyisocyanate and a polyol, such as those polyols described herein. Examples of suitable polyisocyanates include diisocyanates such as aromatic diisocyanates (e.g. toluene diisocyanate (TDI), methylene diphenyl diisocyanate (MDI), and naphthalene diisocyanate (NDI)), alkylisocyanates (e.g. hexamethylene diisocyanate (HDI) and methylene bis-cyclohexylisocyanate (HMDI)), and aliphatic diisocyanates (e.g., isophorone diisocyanate (IPDI)), and the like, as well as combinations, modifications, and self-polymerization products thereof.

The sheet 12 may comprise the resin in any form, such as filaments, particles, melts, sheets, etc. For example, in certain embodiments the sheet 12 comprises a filament comprising the resin. The filament may be continuous or discontinuous with respect to length. In other words, the filament may be a single unbroken filament, or may comprise a plurality of separate filaments. For purposes of clarity, the term "filament" is used herein to referred the filament in its entirety, and thus extends to and encompasses both a single filament or a plurality of filaments comprising the resin, which each may be independently selected and formed in the sheet 12. The filament may be randomized, patterned, linear, non-linear, woven, non-woven, continuous, discontinuous, or may have any other form or combinations of forms. For example, the filament may be a mat, a web, or have other orientations. The filament may be patterned such that the sheet 12 comprises the filament in a nonintersecting manner. For example, the filament may comprise a plurality of linear and parallel filaments or strands. Alternatively, the filament may intersect itself such that the sheet 12 itself comprises a patterned or cross-hatched filament. The pattern or cross-hatching of the sheet 12 may present perpendicular angles, or acute/obtuse angles, or combinations thereof, at each intersecting point of the filament, which orientation may be independently selected at each intersecting point. Further still, the filament may contact and fuse or blend with itself such that portions of, alternatively the entirety of, the sheet 12 is in the form of a film.

In certain embodiments, the sheet 12 is a textile. It is to be understood that the term "textile," as used herein in the context of the sheet 12, is meant to describe an article formed from fiber(s) comprising the resin, by at least one processing technique, such as filament winding, pultrusion, weaving, braiding, knitting, knotting, crocheting, felting, interlacing, interlocking, bonding, and the like. Accordingly, in some embodiments the sheet 12 comprises a resinous fabric, cloth, canvas, weave, and/or screen. Alternatively, the sheet 12 may be a non-woven textile, such as a non-woven fabric. Suitable examples of non-woven fabrics include staple nonwovens, melt-blown nonwovens, spunlaid nonwovens, flashspun nonwovens, air-laid paper, vacuum-formed nonwovens, wet-laid nonwovens, and the like.

It is also to be understood that the sheet 12 need not be a single, contiguous textile, but rather may be any number of individual textiles, which may be the same as or different than one another. For example, the sheet 12 may comprise multiple, individual textiles, each comprising independently selected dimensions including weight, size, shape, height, width, length, color, thickness, and the like. In certain embodiments, the sheet 12 comprises multiple, individual textiles with the same, similar, or different dimensions as one another, each formed from a single piece of textile via cutting, shaping, and the like, or combinations thereof. These multiple textiles may each have a substantially similar color and/or thickness, and may comprise independently selected shapes, lengths and/or widths. In some embodiments, however, the sheet 12 comprises a single piece of textile, and thus may be of unitary construction. In certain embodiments, the sheet 12 is a non-woven fabric comprising fibers and/or filaments of high-density polyethylene.

In some embodiments, the sheet 12 comprises a second resin. Typically, the resin is a thermosetting and/or thermoplastic resin, such as those described above. Accordingly, the second resin may be or comprise the same and/or different resin(s) as the resin described above. In such embodiments, the sheet 12 may comprise layers comprising the resin and/or the second resin.

In certain embodiments, the sheet 12 may comprise an inorganic filler. Typically, the filler comprises an inorganic matrix-forming material. In specific embodiments, the inorganic matrix-forming material comprises a stone, cement, or mineral, such as slag-based fillers, rock-based slag-based fillers, fly ash-based slag-based fillers, ferro-sialate-based ferro-sialate, and the like, or combinations and/or modifications thereof. In these or other embodiments, the inorganic filler comprises a ceramic and/or a silicate. The ceramic and/or silicate is not limited, and may be selected from metal oxides, carbides, nitrides, borides, silicides, and the like, and combination and/or modifications thereof. In certain embodiments, the sheet 12 comprises a stone paper.

Figures 3A, 3B:
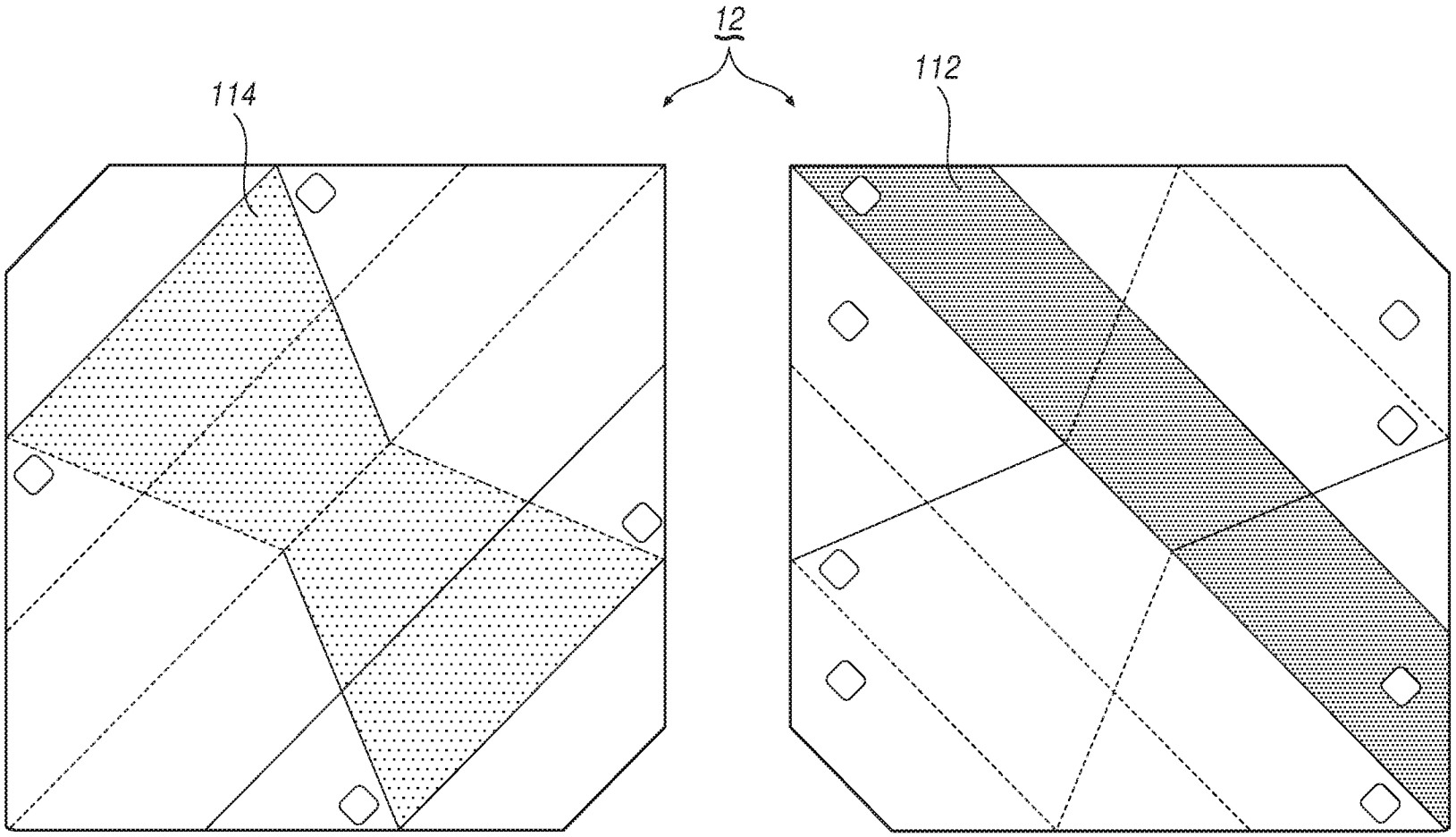
FIG. 3A is a top view of a bracelet cup in accordance with another embodiment.
FIG. 3B is a bottom view of the bracelet cup of FIG. 3A.

As introduced above, in some embodiments, the sheet 12 comprises a printable resilient material, i.e., is a material capable of holding and retaining an ink and/or dye. In these embodiments, the sheet 12 itself may be printable. More specifically, in some embodiments, the sheet 12 is printed with an ink and/or dye. In these embodiments, the sheet 12 may be selectively printed, e.g. in an area that will be exposed when the bracelet cup 10 is folded into the bracelet configuration 96 or the cup configuration 104. For example, as shown in FIG. 3, the sheet 12 may be selectively printed in a bracelet print region 112 and/or a cup print region 114. As will be understood in view of the description herein, the bracelet print region 112 is visible when the bracelet cup 10 is folded into the bracelet configuration 96, and thus may be printed (e.g. with a color, shape, text, picture, pattern, etc.) to provide ornamental designs and/or display(s) to be worn by the user when utilizing the bracelet cup 10 in the bracelet configuration 96. Similarly, the cup print region 114 is visible when the bracelet cup 10 is folded into the cup configuration 104, and thus may be printed to provide ornamental designs and/or display(s) to be worn by the user when utilizing the bracelet cup 10 in the cup configuration 104. For example, the bracelet and/or cup print regions 112, 114 may be printed to provide the bracelet cup 10 with aesthetic value. Alternatively or in addition, the bracelet and/or cup print regions 112, 114 may be printed to provide the bracelet cup 10 with functional information, such as a barcode, identification, a ticket (e.g. an entry pass, drink ticket, etc.), and the like, or combinations of functional information that may be utilized by the user. In this fashion, the bracelet cup 10 may be used in place of conventional wrist bands and/or IDs, e.g. when worn by the user while in the bracelet configuration 96. In certain embodiments, the sheet 12 is printed outside the bracelet and/or cup print regions 112, 114. In these embodiments, the sheet 12 may need be in the unfolded state in order for the print to be visible to the user. In some embodiments, each of the bracelet and/or cup print regions (bracelet and/or cup print regions 112, 114 and the regions of outside of the bracelet and cup print regions bracelet and/or cup print regions 112, 114 of the sheet 12 is independently printed (e.g. with design(s) and/or information) such that the bracelet cup 10 displays a different printing when in the bracelet configuration 96, the cup configuration 104, or in the unfolded state. In certain embodiments, the cup print regions 114 is free from ink and/or die, and is further defined as a food contact region 66. The food contact region 66 may comprise an additional material, such as a coating or a treatment, such that food contact region 66 remains food contact safe, as defined above. In these embodiments, the region of the bracelet cup 10 outside the food contact region may be further defined as a printable region 64.

Figures 4A, 4B:
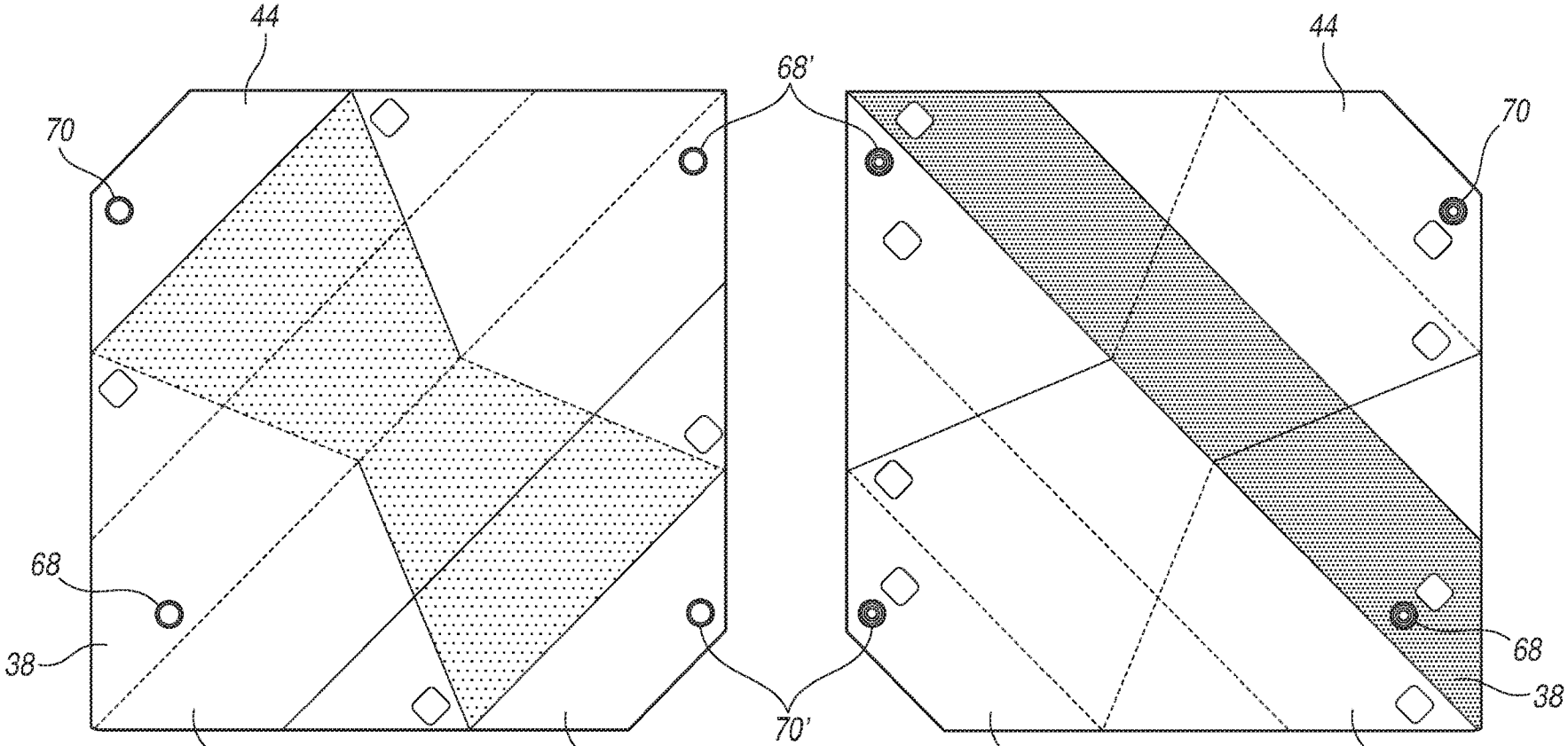
FIG. 4A is a top view of a bracelet cup in accordance with another embodiment.
FIG. 4B is bottom view of the bracelet cup of FIG. 4A.

In addition to the sheet 12, the bracelet cup 10 comprises fasteners to retain the sheet 12 in the bracelet configuration 96 and the cup configuration 104 of the bracelet cup 10, as described in further detail below. In general, the bracelet cup 10 comprises a first pair of fasteners 68, 68' and a second pair of fasteners 70, 70'. Typically, the fasteners 68, 68' of the first pair are disposed on the base regions 38, 38' of the sheet 12, respectively, and the fasteners 70, 70' of the second pair are disposed on the top regions 44, 44' of the sheet 12, respectively, as shown in the embodiment of FIG. 4. The fasteners are not limited, and are generally independently selected from paired fasteners, such as button fasteners, snap fasteners, hook-and-loop fasteners, hook-and-eye fasteners, and the like. For example, in some embodiments, the fasteners comprise two pairs of snaps each comprising a male snap and a female snap. In such embodiments, the fasteners may thus comprise a first pair of snaps (68, 68') and a second pair of snaps (70, 70').

In certain embodiments, the bracelet cup 10 comprises a first plurality of fasteners (68) disposed on one of the base regions 38, 38', and a second plurality of fasteners (68') disposed on the other of the base regions 38, 38'. For example, as shown in FIG. 4, the first plurality of fasteners (68) may be disposed on the base region 38, and the second plurality of fasteners (68') may be disposed on the base region 38'. In such embodiments, each fastener of the first plurality of fasteners (68) is of the same type (e.g. are each male snaps, or are each female snaps) as each other. In these embodiments, each fastener of the second plurality of fasteners (68') is of the same type (e.g. are each female snaps, or are each male snaps) as each other and complimentary to the fasteners of the first plurality of fasteners (68). For example, in certain embodiments, each fasteners of the first plurality of fasteners (68) is a male snap, and each fastener of the second plurality of fasteners (68') is a female snap. In other embodiments, each fastener of the first plurality of fasteners (68) is a female snap, and each fastener of the second plurality of fasteners (68') is a male snap. When the bracelet cup 10 comprises the first and second pluralities of fasteners (68, 68'), the first pair of fasteners 68, 68' comprises one fastener independently selected from each of the first and second pluralities of fasteners (68, 68'). The fasteners of the second pair of fasteners 70, 70' are complementary with one another (i.e., may be coupled together). For example, in specific embodiments one fastener of the second pair of fasteners 70, 70' is a male snap, and the other fastener of the second pair of fasteners 70, 70' is a female snap.

In various embodiments, the bracelet cup 10 comprises a plurality of locators 72, 72'. As best understood in view of the description below, the locator marks 72, 72' may be used to guide the folding of the bracelet cup 10 into the bracelet configuration 94 and/or the cup configuration 104. The locator marks 72, 72' may be integral with the sheet 12 or, alternatively, may be printed on, fastened to, or otherwise attached to the sheet 12 (e.g. on base regions 38, 38', body regions 40, 40', and/or top regions 42, 42'). Additionally, the bracelet cup 10 may comprise any number of locator marks 72, 72', such as one, two, three, or more pairs thereof. Typically, the locator marks 72, 72' are located reflectively about the central living hinge 16, such that when sheet 12 is folded at the central living hinge 16 the locator marks are brought into contact with one another. Alternatively, or in addition, the bracelet cup 10 may comprise additional locator marks 72, 72' which are not located reflectively about the central living hinge 16, but are rather located to guide the folding of the bracelet cup 10 at one or more other living hinges.

As introduced above, the bracelet cup 10 may be folded into, and interfolded between the bracelet configuration 94 and the cup configuration 104. As will be appreciated from the description below, the bracelet configuration 94 and the cup configuration 104 are each independently foldable from the sheet 12 in the unfolded (i.e., flat) state. As such, when starting from the sheet 12 in the unfolded state, the user may fold the bracelet cup 10 into either the bracelet configuration 94 or the cup configuration 104. Moreover, the user may fold the bracelet cup 10 from either of the bracelet configuration 94 or the cup configuration 104 into the another, as described below.

Figure 5A:
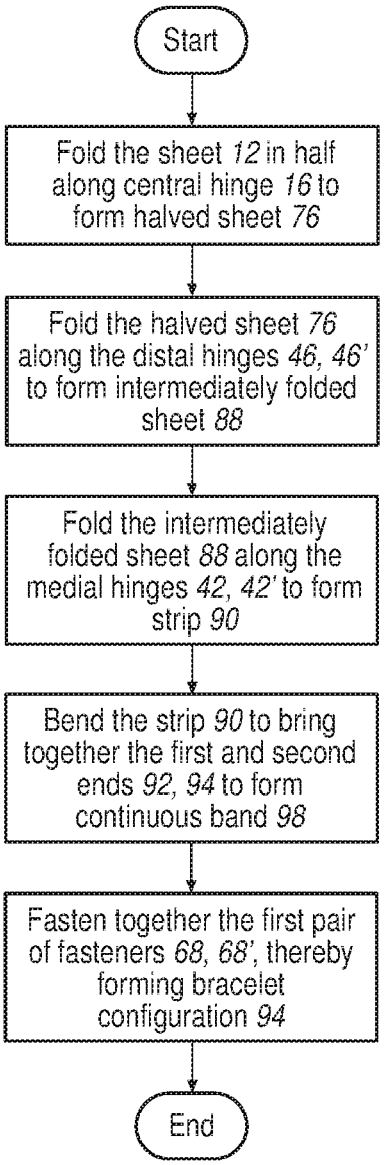
FIG. 5A is a flow diagram of a method of forming a bracelet with a bracelet cup in accordance with one embodiment.
Figure 5B:
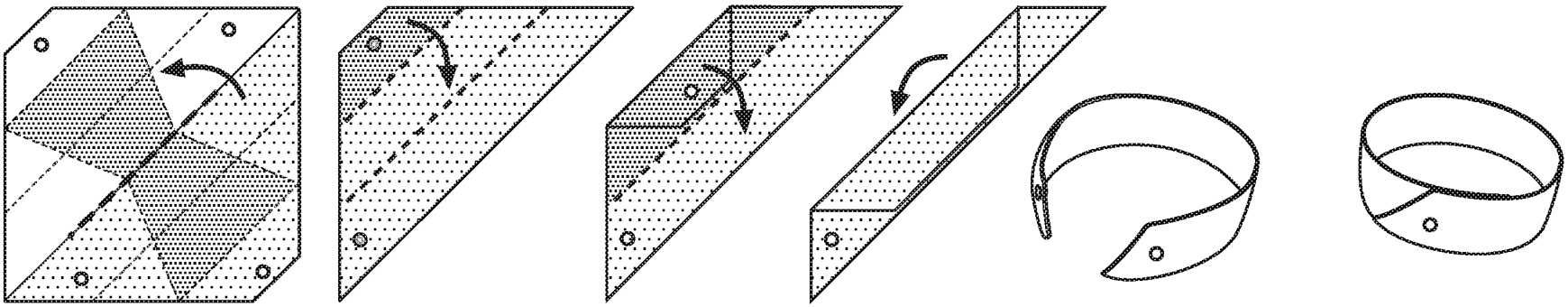
FIG. 5B is a step-wise multi-perspective view of the flow diagram of FIG. 5A.

A sequence of folding steps to fold the bracelet cup 10 into the bracelet configuration 94 is shown in FIG. 5. In particular, folding the bracelet cup 10 into the bracelet configuration 94 includes first folding the sheet 12 in half along the central living hinge 16 to align together the first and second portions 26, 26', thereby forming a halved sheet 76. When the sheet 12 is configured (e.g. folded in half) as the halved sheet 76, the short base sides 28, 28' are aligned together, the first diagonal sides 36, 36' are aligned together, and the second diagonal sides 37, 37' are aligned together. Moreover, when so aligned, the distal living hinges 46, 46' are aligned and overlapped with one another, and the medial living hinges 42, 42' are aligned and overlapped with one another.

Folding the bracelet cup 10 into the bracelet configuration 94 also includes inwardly folding the halved sheet 76 along the distal living hinges 46, 46', thereby forming an intermediately folded sheet 88.

Folding the bracelet cup 10 into the bracelet configuration 94 further includes folding the intermediately folded sheet 88 along the medial living hinges 42, 42', thereby forming a strip 90 having a first end 92 a second end 94.

Finally, folding the bracelet cup 10 into the bracelet configuration 94 also includes bending the strip 90 to bring together the first and second ends 92, 94 to form a continuous band 98, and then fastening together the first pair of fasteners 68, 68'. When so fastened, the first pair of fasteners 68, 68' function to retain the bracelet cup 10 in the bracelet configuration 94.

Each of the first and second ends 92, 94 of the strip 90 includes at least one fastener of the first pair of fasteners 68, 68'. More specifically, the first end 92 of the strip 90 includes one fastener of the first pair of fasteners 68, 68', which is disposed on one of an inner surface 100 and an outer surface 102 of the strip 90. The second end 94 of the strip 90 includes the other fastener of the first pair of fasteners 68, 68', which is disposed on the other of the inner and outer surfaces 100, 102 of the strip 90. In certain embodiments the first end 92 comprises one of the first and second pluralities of fasteners (68, 68'), and the second end 94 comprises the other of the first and second pluralities of fasteners (68, 68'). In such embodiments, the first pair of fasteners 68, 68' is selected from the first and second pluralities of fasteners (68, 68'), such that the bracelet configuration 94 of the bracelet cup 10 is adjustable (e.g. depending on which particular fasteners are fastened together.

The bracelet cup 10 may be unfolded from the bracelet configuration 94 by reversing the folding sequence described above, thereby placing the sheet 12 of the bracelet cup 10 in the unfolded state.

Figure 6A:
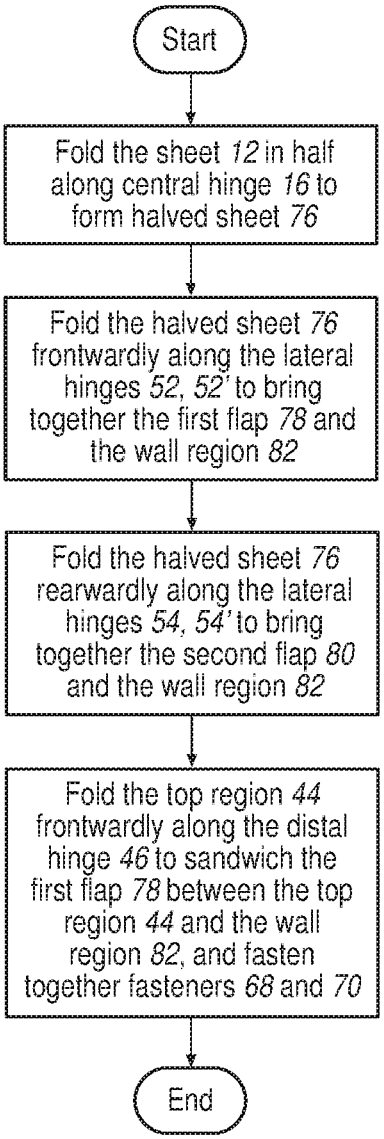
FIG. 6A is a flow diagram of a method of forming a cup with a bracelet cup in accordance with one embodiment.
Figure 6B:
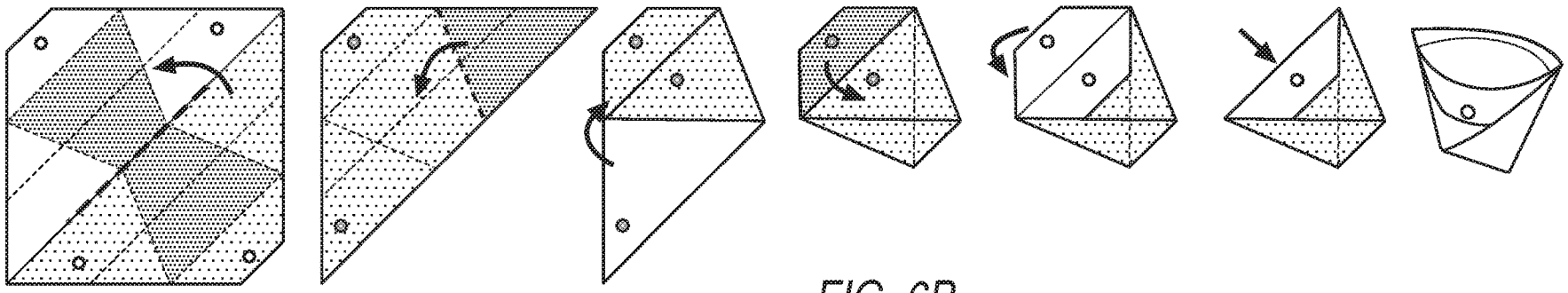
FIG. 6B is a step-wise multi-perspective view of the flow diagram of FIG. 6A.

A sequence of folding steps to fold the bracelet cup 10 into the cup configuration 104 is shown in FIG. 6. In particular, folding the bracelet cup 10 into the cup configuration 104 includes first folding the sheet 12 in half along the central living hinge 16 to form the halved sheet 76 as described above. As so folded, the halved sheet 76 includes a first flap 78 between the first lateral living hinges 52, 52' and the first end 18 of the central living hinge 16, a second flap 80 between the second lateral living hinges 54, 54' and the second end 20 of the central living hinge 16, and a wall region 82 therebetween. The halved sheet 76 also includes a first side surface 84 and a second side surface 86 (not shown) opposite the first side surface 84.

Folding the bracelet cup 10 into the cup configuration 104 also includes folding the halved sheet 76 along the first lateral living hinges 52, 52' to bring the first flap 78 to the first side surface 84 of the wall region 82 of the halved sheet 76, and folding the halved sheet 76 along the second lateral living hinges 54, 54' to bring the second flap 80 to the second side surface 86 of the wall region 82. Folded as such, the first pair of fasteners 68, 68' are disposed on the first and second flaps 78, 80, respectively, opposite one another.

Folding the bracelet cup 10 into the cup configuration 104 further includes outwardly folding the top region 44 of the first portion 26 along the distal living hinge 46 to sandwich the first flap 78 between the top region 44 and the first side surface 84 of the wall region 82, and outwardly folding the top region 44' of the second portion 26' along the distal living hinge 46' to sandwich the second flap 80 between the top region 44' and the second side surface 86 of the wall region 82.

Lastly, folding the bracelet cup 10 into the cup configuration 104 further includes fastening the top region 44 of the first portion 26 to the first flap 78 via the one fastener of the first pair of fasteners (68, 68') disposed on the first flap 78 and the fastener 70 of the second pair of fasteners (70, 70') to form a first side wall 106, and fastening the top region 44' of the second portion 26' to the second flap 80 via the other fastener of the first pair of fasteners (68, 68') disposed on the second flap 80 and the fastener 70' of the second pair of fasteners (70, 70') to form a second side wall 108 and thereby from the cup configuration 104. In the cup configuration 104, the first and second side walls 106, 108, which meet along the bottom portion 116 of the cup configuration 104, define an interior 100 for receiving the substance.

The nature and/or identity of the substance is not limited, and may be a liquid, solid, or combinations thereof. For example, in some embodiments, the bracelet cup 10 may be adapted to hold or transport a liquid when in the cup configuration 104. In such embodiments, when in the cup configuration 104, the bracelet cup 10 may be used to hold, carry, or otherwise transport the liquid without leaking. In other words, in the cup configuration 104, the bracelet cup 10 may be considered "water tight." However, it is to be appreciated that the bracelet cup 10 may be adapted or otherwise used to transport non-liquid substances, such as granular foods (e.g. for human or animal consumption), natural or synthetic particles (e.g. salt, sand, dirt, rocks, beads, etc.), and the like, or combinations thereof. In certain embodiments, the bracelet cup 10 is further defined as a drinking cup 10 when in the cup configuration 104. In such embodiments, the drinking cup 10 is adapted to hold and transport a liquid for drinking (e.g. a beverage), such as water, soda, juice, sports drink, energy drink, tea, coffee, alcoholic drink, and the like, or combinations thereof, when in the cup configuration 104. In some embodiments, the drinking cup 10 is adapted to hold non-beverage or non-potable liquids when in the cup configuration 104. In particular embodiments, the drinking cup 10 is adapted to hold solids such as granular and/or particulate solids, when in the cup configuration 104.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. A foldable cup bracelet, comprising:

a sheet of resilient material foldable between a bracelet configuration and a cup configuration, wherein the bracelet configuration comprises a continuous band having an inner surface and an outer surface, and wherein the cup configuration comprises a first side wall and a second side wall opposing the first side wall, with the first and second sidewalls defining an interior for receiving a substance;

a first pair of fasteners configured to retain the sheet of resilient material in the bracelet configuration; and a second pair of fasteners configured to cooperate with the first pair of fasteners to retain the sheet of resilient material in the cup configuration.

2. The foldable cup bracelet of claim 1, wherein the resilient material comprises a resin.

3. The foldable cup bracelet of claim 2, wherein the resin comprises: (i) a polyolefin; (ii) a polyurethane; (iii) an inorganic filler; or (iv) any of (i)-(iii).

4. The foldable cup bracelet of claim 1, wherein the sheet of resilient material is a non-woven fabric comprising fibers of the high-density polyethylene.

5. The foldable cup bracelet of claim 1, wherein the sheet of resilient material comprises:

an irregular hexagonal perimeter shape symmetric about a reference line extending between and bisecting two opposite vertices thereof, the reference line separating congruent first and second portions each having an isosceles-trapezoidal perimeter shape defined by a long base side coincident with the reference line, a short base side parallel to the long base side, and opposing diagonal sides connected acutely to opposing ends of the long base side and obtusely to opposing ends of the short base side; and a central living hinge being disposed between and operatively connecting the first and second portions along the reference line.

6. The foldable cup bracelet of claim 5, wherein the first and second portions each comprise a base region adjacent the long base side, a top region adjacent the short base side, and a body region disposed therebetween, the base and body regions separated and operatively connected by a medial living hinge, the body and top regions separated and operatively connected by a distal living hinge, with the medial and distal living hinges extending parallel to the central living hinge such that each of the base, body, and top regions have isosceles-trapezoidal perimeter shapes.

7. The foldable cup bracelet of claim 6, wherein one fastener of the first pair of fasteners is disposed on the base region of one of the first and second portions, and the other fastener of the first pair of fasteners is disposed on the base region of the other of the first and second portions.

8. The foldable cup bracelet of claim 7, wherein the sheet of resilient material is foldable into the bracelet configuration by:

folding the sheet of resilient material in half along the central living hinge to align together the long base sides, short base sides, and diagonal sides of the congruent first and second portions with one another such that the medial and distal living hinges of the first and second portions are also aligned and overlapped, thereby forming a halved sheet;

inwardly folding the halved sheet along the aligned distal living hinges to bring the top regions to the body regions such that the top regions overlap the body regions, thereby forming an intermediately folded sheet;

folding the intermediately folded sheet along the medial living hinges to sandwich the top regions between the body regions and the base regions, thereby forming a strip having a first end and a second end, the strip having a perimeter shape congruent with the isosceles-trapezoidal perimeter shape of the base regions;

bending the strip to bring together the first and second ends thereof and form a continuous band; and fastening together the first pair of fasteners to place the foldable cup bracelet into the bracelet configuration.

9. The foldable cup bracelet of claim 8, wherein the base region of the first portion comprises a first plurality of fasteners, the base region of the second portion comprises a second plurality of fasteners, and the first pair of fasteners comprises one fastener independently selected from each of the first and second pluralities of fasteners.

10. The foldable cup bracelet of claim 9, wherein the first plurality of fasteners comprise complementary coupling features to the second plurality of fasteners such that (i) each fastener of the first plurality of fasteners is a male snap and each fastener of the second plurality is a female snap; or (ii) each fastener of the first plurality of fasteners is a female snap and each fastener of the second plurality is a male snap.

11. The foldable cup bracelet of claim 7, wherein one fastener of the second pair of fasteners is disposed on the top region of one of the first and second portions, and the other fastener of the second pair of fasteners is disposed on the top region of the other of the first and second portions.

12. The foldable cup bracelet of claim 11, wherein the first and second portions each comprise a first lateral living hinge that extends inwardly from a first end of the distal living hinge to the central living hinge, and a second lateral living hinge that extends inwardly from a second end of the distal living hinge to the central living hinge.

13. The foldable cup bracelet of claim 12, wherein the sheet of resilient material is foldable into the cup configuration by:

folding the sheet of resilient material in half along the central living hinge to align together the long base sides, the short base sides, and the diagonal sides of the congruent first and second portions with one another such that the first and second lateral living hinges are also aligned and overlapped, thereby forming a halved sheet comprising a first flap between the first lateral living hinges and a first end of the central living hinge, a second flap between the second lateral living hinges and a second end of the central living hinge, and a wall region between the first and second flaps including the base and body regions between the distal living hinges and the central living hinge;

folding the halved sheet along the first lateral living hinge to bring the first flap to a first side surface of the wall region, and along the second lateral living hinge to bring the second flap to a second side surface of the wall region opposite the first side surface;

outwardly folding the top region of the first portion along the distal hinge thereof to sandwich the first flap between the top region and the first side surface of the wall region, and outwardly folding the top region of the second portion along the distal hinge thereof to sandwich the second flap between the top region and the second side surface of the wall region; and fastening the top region of the first portion to the first flap via one fastener of the first pair of fasteners and one fastener of the second pair of fasteners to form a first side wall, fastening the top region of the second portion to the second flap via the other fastener of the first pair of fasteners and the other fastener of the second pair of fasteners to form a second side wall, the first and second side walls thereby defining the interior for receiving the substance.

14. The foldable cup bracelet of claim 1, wherein: (i) the cup is a drinking cup; (ii) the substance comprises a liquid; or (iii) both (i) and (ii).

15. A foldable cup bracelet, comprising:

a sheet of resilient material foldable between a bracelet configuration and a cup configuration, the sheet comprising a central living hinge operatively connecting congruent first and second portions each having a distal living hinge parallel to the central living hinge, a medial living hinge parallel to and disposed between the central and distal living hinges, a first lateral living hinge extending from a first end of the distal living hinge to the central living hinge, and a second lateral living hinge extending from a second end of the distal living hinge to the central living hinge;

a first pair of fasteners configured to retain the sheet of resilient material in the bracelet configuration;

wherein the bracelet configuration is formed by:

folding the sheet of resilient material in half along the central living hinge to align together the congruent first and second portions and the distal and medial hinges thereof, thereby forming a halved sheet, the halved sheet comprising a first lateral living hinge extending inwardly from a first end of the distal living hinges to the central living hinge, and a second lateral living hinge extending inwardly from a second end of the distal living hinge to the central living hinge, inwardly folding the halved sheet along the distal living hinges, thereby forming an intermediately folded sheet, folding the intermediately folded sheet along the medial living hinges, thereby forming a strip having a first end a second end, bending the strip to bring together the first and second ends thereof and form a continuous band, and fastening together the first pair of fasteners; and a second pair of fasteners configured to cooperate with the first pair of fasteners to retain the sheet of resilient material in the cup configuration;

wherein the cup configuration is formed by:

folding the sheet of resilient material in half along the central living hinge to form the halved sheet, folding the halved sheet along the first lateral living hinge to bring a first flap to a first side surface of a wall region of the halved sheet, and folding the halved sheet along the second lateral living hinge to bring a second flap to a second side surface of the wall region opposite the first side surface, outwardly folding a top region of the first portion along the distal hinge thereof to sandwich the first flap between the top region of the first portion and the first side surface of the wall region, and outwardly folding a top region of the second portion along the distal hinge thereof to sandwich the second flap between the top region of the second portion and the second side surface of the wall region, fastening the top region of the first portion to the first flap via one fastener of the first pair of fasteners and one fastener of the second pair of fasteners to form a first side wall, fastening the top region of the second portion to the second flap via the other fastener of the first pair of fasteners and the other fastener of the second pair of fasteners to form a second side wall, the first and second side walls thereby defining an interior for receiving a substance.

16. The foldable cup bracelet of claim 15, wherein the first portion comprises a first plurality of fasteners, the second portion comprises a second plurality of fasteners, and the first pair of fasteners comprises one fastener independently selected from each of the first and second pluralities of fasteners.

17. The foldable drinking cup bracelet of claim 16, wherein (i) each fastener of the first plurality of fasteners is a male snap and each fastener of the second plurality is a female snap; or (ii) each fastener of the first plurality of fasteners is a female snap and each fastener of the second plurality is a male snap.

18. The foldable cup bracelet of claim 15, wherein the second pair of fasteners comprises a male fastener and a female fastener.

19. The foldable cup bracelet of claim 15, wherein the sheet of resilient material is: (i) food contact safe; (ii) impermeable to liquid; (iii) printable; or (iv) a combination of (i) to (iii).

20. A foldable drinking cup bracelet, comprising:

a sheet of resilient material foldable between a bracelet configuration and a drinking cup configuration, wherein the bracelet configuration comprises a continuous band having an inner surface and an outer surface, and wherein the drinking cup configuration comprises a first side wall and a second side wall opposing the first side wall, with the first and second sidewalls defining an interior for receiving a liquid;

a first pair of fasteners configured to retain the sheet of resilient material in the bracelet configuration; and a second pair of fasteners configured to cooperate with the first pair of fasteners to retain the sheet of resilient material in the drinking cup configuration.

* * * * *